United States Patent [19]

Younjae

[11] Patent Number: 4,981,387

[45] Date of Patent: Jan. 1, 1991

[54] CONNECTOR FOR TUBULAR POLES OF A DOME-TYPE TENT

[75] Inventor: Lee Younjae, Seoul, Rep. of Korea

[73] Assignee: Jinwoong, Ltd., Rep. of Korea

[21] Appl. No.: 303,925

[22] Filed: Jan. 30, 1989

[30] Foreign Application Priority Data

Dec. 27, 1988 [KR] Rep. of Korea ..... 88-21582

[51] Int. Cl.[5] ..... F16B 7/00; E04H 15/44

[52] U.S. Cl. ..... 403/174; 403/178; 135/106

[58] Field of Search ..... 135/104, 106; 403/174, 403/178, 170, 175, 217, 218, 173, 171, 176, 169, 172

[56] References Cited

U.S. PATENT DOCUMENTS

| | | | |
|---|---|---|---|
| 1,316,155 | 9/1919 | Harrison | 403/173 X |
| 3,693,641 | 9/1972 | Moss | 135/104 |
| 3,810,342 | 5/1974 | Scott | 403/173 |
| 3,972,638 | 8/1976 | Vivoli | 403/174 |
| 4,569,165 | 2/1986 | Baker et al. | 403/171 X |
| 4,603,519 | 8/1986 | Lew et al. | 403/174 X |
| 4,706,696 | 11/1987 | Gillis | 135/106 X |

FOREIGN PATENT DOCUMENTS

| | | | |
|---|---|---|---|
| 3330860 | 3/1985 | Fed. Rep. of Germany | 135/106 |

*Primary Examiner*—Peter M. Cuomo
*Attorney, Agent, or Firm*—Clifford A. Poff

[57] ABSTRACT

A connector for tubular poles of a dome type tent includes a disk shaped based section with a central aperture surrounded by upstanding walls at each of opposite sides of the base section. The upstanding walls are reinforced by cross walls in the aperture. Sockets are formed by walls on opposite sides of the base section. The sockets are equiangularally arranged so that the socket extend radially about the base section for receiving end portions of the tubular poles. An elastic member extending from the end of each pole is threaded through an opening in an anchor wall separating a socket from the central aperture. The end portion of the elastic member in the aperture is tied in a knot whereby the pole cannot be completely separated from the connector.

11 Claims, 1 Drawing Sheet

CONNECTOR FOR TUBULAR POLES OF A DOME-TYPE TENT

BACKGROUND OF THE INVENTION

1. Field of the Invention

This invention relates to a connector for supporting end positions of pole members to form part of a dome-type tent. More particularly, the present invention provide a connector designed to facilitate assembly and disassembly with tubular poles and which is resistant to stresses generated by the surrounding environment of the tent.

2. Description of the Prior Art

As is well known in the art, a tent is a collapsible shelter of canvas or other material stretched and sustained by poles and used for camping outdoors or as a temporary building. The present invention is addressed to a particular tent design called a dome-type tent which is characterized by the use of long flexible poles typically made of fiberglass to impart the needed elasticity. Plastics are also suitable pole materials. The poles are elastically bent and arranged to form a shape of a dome. Each pole receives an aligned row of spaced apart eyelets that are sewn or otherwise connected to the material forming the body of the tent. Thus, it is necessary to use poles having a predetermined length so that when each pole is bent, the tent body material is supported along each row of eyelets. However a person carrying a disassembled dome-type tent may experience a problem handling poles that are relatively long.

A pole can be made up of a number of tubular pole sections having selected lengths and joined together by tubular sleeves so that the tubular sleeves are situated at the sides of the tent. An elastic cord or rubber band extends internally along the length of each tubular pole whereby all the tubular pole sections always remain linked together even though the pole sections may be disjoined from the sleeves for better handling of the poles e.g., during times of assembly or transport of the tent. Two or three tubular poles are generally used as part of a dome-shaped tent and the poles cross one another at the top of tent. This form of a dome-type tent is light weight and strong. However, inconvenience occurs because the poles must be removed from the eyelets on the tent body material when the tent is to be taken down. Similarly, the poles must be threaded in the eyelets when the tent is pitched. Also, there is a state of flux among the poles in the area at the top of the tent where the poles cross one another. This leads to instability particularly due to wind during a storm which may result in a collapse of the tent.

There is a so-called "60 second tent" design of a dome tent wherein the poles become a unitary body because a connecting part among the tubular poles can fold to solve the aforesaid problem. While this has the advantage for pitching and disassembling the tent, the pole-connecting part among the poles to be folded is so weak that the tent lacks the necessary rigidity.

SUMMARY OF THE PRESENT INVENTION

It is an object of the present invention to provide a connector design for connecting together poles of dome type tent in a radially extending relation at the top portion of the tent which will overcome the problems and shortcomings of known designs of dome-type tents.

According the present invention there is provided a dome type tent having elongated poles with an elastic member provided in the end portion of each pole, a pole connector including a base section having an aperture extending perpendicular to each of a plurality of elongated sockets formed by wall section extending in radial directions about the base section for supporting end portions of the elongated poles, an anchor wall separating each of the wall sections from the aperture of the base section, each anchor wall having a passageway dimension to pass an elastic member from the end portion of one of the elongated poles into said aperture and prevent withdrawal of tied end portion of the elastic member from the aperture.

The number of elongated sockets formed by the wall sections corresponds to the number of poles extending about the top part of the tent. Typically the connector of the present invention is constructed to receive end portions of four, six or eight poles arranged equiangularly from one another about the base section. To impart rigidity to the base section of the connector, the base section is provided with an upstanding wall surrounding the aperture and forming a reinforcement rib. When the poles are joined with the connector of the present invention a unitary body is formed as part of the tent.

BRIEF DESCRIPTION OF THE DRAWINGS

These features and advantages of the present invention as well as others will be more fully understood when the following description is read in light of the accompanying drawings in which.

DETAILED DESCRIPTION OF THE PREFERRED EMBODIMENTS

Figure 1:
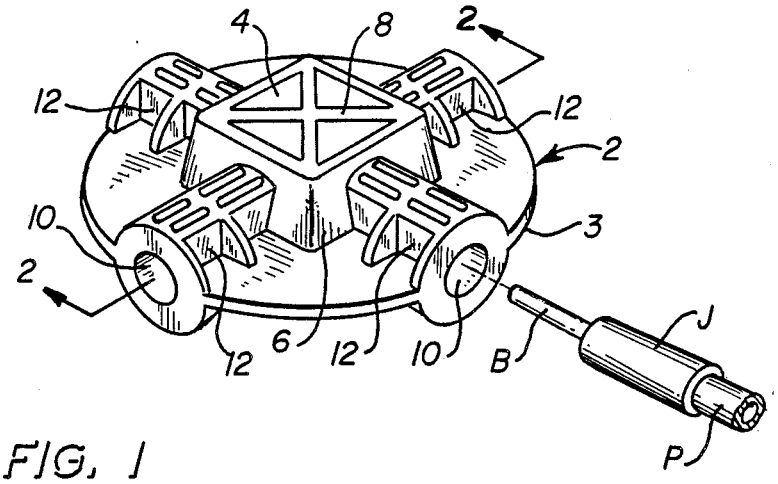
FIG. 1 a perspective view of a pole connector according to a preferred embodiment of the present invention.
Figure 2:
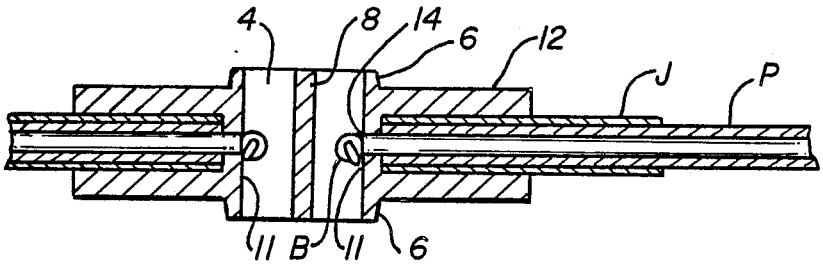
FIG. 2 is a sectional view taken along lines 2—2 of FIG. 1.

As shown in FIGS. 1 and 2, a connector 2 includes a disk-shaped base section 3 having a central aperture 4. An upstanding wall 6 at each of the opposite sides of the base section is reinforced and strengthened by cross walls 8 arranged in the shape of an "X" within the aperture 4. The relationship formed by cross wall 8 being surrounded by walls 6 prevents deformation of the connector due to sudden temperature changes, e.g., severe heat or bitter cold, and at the same time prevents damage due to forces caused by wind.

Elongated radially extending sockets 10 are located at equiangular sites around the circumference of the base section 3. There are four such sockets in the embodiment of the present invention shown in FIGS. 1–3 for the particular quadrangular dome type tent shown in FIG. 3. Six or eight sockets will be arranged at equiangular sites as necessary for use in a hexagonal or octagonal dome type tent. However, it is contemplated that the base 3 may be provided with any suitable number of sockets 10 to correspond with an equivalent number of poles in order to achieve the desired results of the present invention. Each socket is formed by wall sections that include ribs 12 at each opposite face surface of the base section 3. The ribs 12 function like walls 8 to reinforce and strengthen the side wall areas of the sockets. The ribs 12 can be shaped as preferred but it is desirable to select a shape for the ribs that avoids an increase to the weight of the connector. The ribs 12 are another part of the connector structure designed to withstand sudden temperature changes and forces due to wind.

A portion of the wall 6 which closes off the inboard end of each socket 10 forms an anchor wall 11. A passageway 14 is formed in each anchor wall. The passageway is dimensioned to pass an end portion of an elastic member B which extends from the end of a tubular pole member P. A knot is then formed in the portion of the elastic member which is in the aperture 4. The size of the passageway is too small to allow the knot to pass from aperture 4 to the socket.

The end portion of pole member P is provided with a joinder sleeve J which can fit in a socket 10. Once the elastic member is threaded in the passage way 14 and knotted in the aperture 4, the pole member P with the joinder sleeve thereon can be removed from the socket 10 without becoming completely separated from the connector because of the continuous interconnection between the pole and the connector provided by the elastic member.

Figure 3:
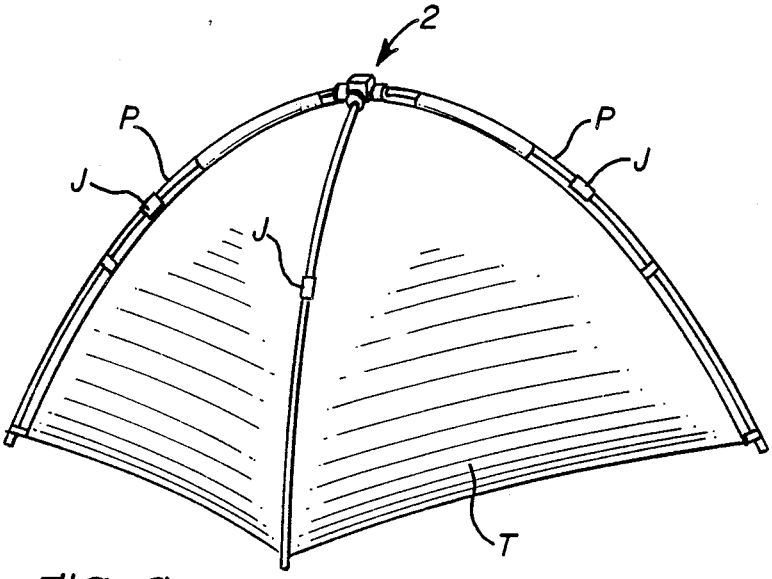
FIG. 3 is a perspective view of a dome-type tent embodying a connector for poles according to the present invention.

FIG. 3 illustrates a dome type tent incorporating the connector 2 of the present invention. The connector is located at the top portion of the tent T and supports the end portions of the pole members P to extend radially from the sockets 10 so that the tent is formed. The tent is pitched by the same method as carried out with previous dome type tents. This includes connecting together a number of tubular pole members P by the use of joinder sleeves J. When the tent is to be folded up, the tubular pole members P forming each tubular pole are disassembled from the various joiner sleeves and the tent body material is folded or rolled to a compact size. The tubular pole members are not separated entirely from the tent body material but are placed centrally on the top part of the tent which, upon reassembly becomes the first portion of the tent material to be unfolded. This is because of the pole members being connected to the connector 2 by the elastic member B. The present invention avoids the inconvenience when pitching or taking down a tent wherein the poles are entirely separated from the tent body. Also the poles are maintained in a mutually intersecting relationship by the use of the connector 2 at the top of the tent which provides rigidity to the tent. This is advantageous when the tent is used during bad weather conditions such as a storm.

While the present invention has been described in connection with the preferred embodiment shown in the various figures, it is understood that other similar embodiments may be used or modifications and additions may be made to the described embodiment for performing the same functions of the present invention without deviating therefrom. Therefore, the present invention should not be limited to any single embodiment, but rather construed in breadth and scope in accordance with recitation of the appended claims.

What is claimed is:

1. In a dome type tent having elongated poles with an elastic member in an end portion of each pole, a pole connector including a base section having an aperture extending perpendicular to each of a plurality of elongated sockets formed by wall sections extending in radial directions about said base section for supporting end portions of said elongated poles, said base section including an upstanding wall surrounding said aperture, said wall sections including at least one reinforcing rib at the circumference of the elongated sockets, an anchor wall separating each of said wall sections from the aperture of said base section, each anchor wall having a passageway dimensioned to pass an elastic member from the end portion of one of said elongated poles into said aperture and prevent withdrawal of a tied end portion of the elastic member from said aperture.

2. The pole connector according to claim 1 wherein said elongated sockets formed by said wall sections are equally angularly spaced from one another.

3. The pole connector according to claim 1 further including a wall means traversing the aperture of said base section for preventing deformation of said base section.

4. The pole connector according to claim 3 wherein said wall means includes a cross wall having an X-shaped configuration in cross section.

5. In a dome type tent having elongated poles with an elastic member in an end portion of each pole, a pole connector including a disk-shaped base section having an aperture extending perpendicular to each of a plurality of elongated sockets formed by wall sections extending in radial directions about said base section for supporting end portions of said elongated poles, said wall sections including at least one reinforcing rib at the circumference of the elongated sockets, an anchor wall separating each of said wall sections from the aperture of said base section, each anchor wall having a passageway dimensioned to pass an elastic member from the end portion of one of said elongated poles into said aperture and prevent withdrawal of a tied end portion of the elastic member from said aperture.

6. The pole connector according to claim 5 further including a wall means traversing the aperture of said base section for preventing deformation of said base section.

7. The pole connector according to claim 6 wherein said wall means includes a cross wall having an X-shaped configuration in cross section.

8. The pole connector according to claim 5 wherein said elongated sockets formed by said wall sections are equally angularly spaced from one another.

9. The pole connector according to claim 5 wherein said base section includes an upstanding wall surrounding said aperture.

10. The pole connector according to claim 9 further including a wall means traversing the aperture of said base section for preventing deformation of said base section.

11. The pole connector according to claim 10 wherein said wall means includes a cross wall having an X-shaped configuration in cross section.

* * * * *